US008981899B2

(12) United States Patent
Pukari et al.

(10) Patent No.: US 8,981,899 B2
(45) Date of Patent: Mar. 17, 2015

(54) ELECTROMECHANICAL LOCK

(75) Inventors: Mika Pukari, Oulu (FI); Hannu Jokinen, Oulunsalo (FI)

(73) Assignee: iLoq Oy, Oulu (FI)

( * ) Notice: Subject to any disclaimer, the term of this patent is extended or adjusted under 35 U.S.C. 154(b) by 624 days.

(21) Appl. No.: 12/669,204

(22) PCT Filed: Jul. 16, 2008

(86) PCT No.: PCT/FI2008/050436

§ 371 (c)(1),
(2), (4) Date: Jan. 15, 2010

(87) PCT Pub. No.: WO2009/010639

PCT Pub. Date: Jan. 22, 2009

(65) Prior Publication Data

US 2010/0188190 A1 Jul. 29, 2010

(30) Foreign Application Priority Data

Jul. 18, 2007 (EP) ..... 07112673

(51) Int. Cl.

| | |
|---|---|
| ***G06F 7/04*** | (2006.01) |
| ***E05B 47/06*** | (2006.01) |
| *E05B 35/00* | (2006.01) |
| *E05B 47/00* | (2006.01) |

(52) U.S. Cl.

CPC ..... *E05B 47/063* (2013.01); *E05B 35/00* (2013.01); *E05B 2047/0031* (2013.01); *E05B 2047/0062* (2013.01)

USPC ..... 340/5.73; 70/271; 70/277; 70/278.1; 70/280; 70/282; 340/5.1; 340/5.2; 340/5.7

(58) Field of Classification Search

USPC ..... 340/5.73, 5.1, 5.2, 1.1, 5.7; 70/271, 70/277, 278.1, 280, 282

See application file for complete search history.

(56) References Cited

U.S. PATENT DOCUMENTS

| | | | | |
|---|---|---|---|---|
| 4,320,389 | A * | 3/1982 | Caruso | 340/5.1 |
| 4,577,477 | A * | 3/1986 | Olshausen | 70/58 |
| 4,593,543 | A * | 6/1986 | Stefanek | 70/134 |
| 4,665,727 | A * | 5/1987 | Uyeda | 70/279.1 |
| 4,824,151 | A * | 4/1989 | Taylor | 292/201 |
| 5,691,711 | A * | 11/1997 | Jorgensen | 340/5.67 |
| 6,331,812 | B1 * | 12/2001 | Dawalibi | 340/5.2 |
| 6,622,534 | B1 * | 9/2003 | Miller et al. | 70/92 |
| 6,741,160 | B1 * | 5/2004 | Dawson et al. | 340/5.55 |
| 6,813,917 | B2 * | 11/2004 | Miller et al. | 70/303 A |
| 6,867,685 | B1 * | 3/2005 | Stillwagon | 340/5.64 |

(Continued)

FOREIGN PATENT DOCUMENTS

| | | | |
|---|---|---|---|
| DE | 19519789 | A1 | 12/1996 |
| EP | 1606616 | A1 | 7/2007 |

(Continued)

*Primary Examiner* — Naomi Small

(74) *Attorney, Agent, or Firm* — Birch, Stewart, Kolasch & Birch, LLP

(57) ABSTRACT

An electromechanical lock and its operation method is disclosed. The method includes: reading data from an external source; matching the data against a predetermined criterion; providing a fulcrum provided that the data matches the predetermined criterion; holding the lock by a locking pin, when engaged, in a locked state, and, when disengaged, in a mechanically openable state; and if the fulcrum is provided, levering mechanical power with the fulcrum to the locking pin to mechanically disengage the locking pin.

24 Claims, 14 Drawing Sheets

(56) References Cited

U.S. PATENT DOCUMENTS

| | | | | |
|---|---|---|---|---|
| 6,911,897 | B2 * | 6/2005 | Miller et al. | 340/5.55 |
| 7,424,814 | B2 * | 9/2008 | Jasper | 70/92 |
| 2005/0280500 | A1 * | 12/2005 | Miller et al. | 340/5.55 |
| 2006/0101875 | A1 * | 5/2006 | Key | 70/85 |
| 2006/0150690 | A1 * | 7/2006 | Lai et al. | 70/21 |
| 2006/0260371 | A1 * | 11/2006 | Williams | 70/493 |

FOREIGN PATENT DOCUMENTS

| | | | |
|---|---|---|---|
| EP | 2017412 | A1 | 1/2009 |
| EP | 2017795 | A1 | 1/2009 |
| WO | WO 98/28508 | A1 | 7/1998 |
| WO | WO 99/018310 | A1 | 4/1999 |
| WO | WO 2007/066794 | A1 | 6/2007 |

* cited by examiner

ELECTROMECHANICAL LOCK

FIELD

The invention relates to an electromechanical lock and its operation method.

BACKGROUND

Various types of electromechanical locks are replacing the traditional mechanical locks. Electromechanical locks require an external supply of electric power, a battery inside the lock, a battery inside the key, or means for generating electric power within the lock making the lock user-powered. Further refinement is needed for making the electromechanical locks to consume as little electric power as possible.

BRIEF DESCRIPTION

The invention is defined in the independent claims.

LIST OF DRAWINGS

Embodiments of the present invention are described below, by way of example only, with reference to the accompanying drawings, in which FIG. 1A illustrates an embodiment of a key;

DESCRIPTION OF EMBODIMENTS

The following embodiments are exemplary. Although the specification may refer to "an", "one", or "some" embodiment(s) in several places, this does not necessarily mean that each such reference is made to the same embodiment(s), or that the feature only applies to a single embodiment. Single features of different embodiments may also be combined to provide other embodiments.

Figure 3A:
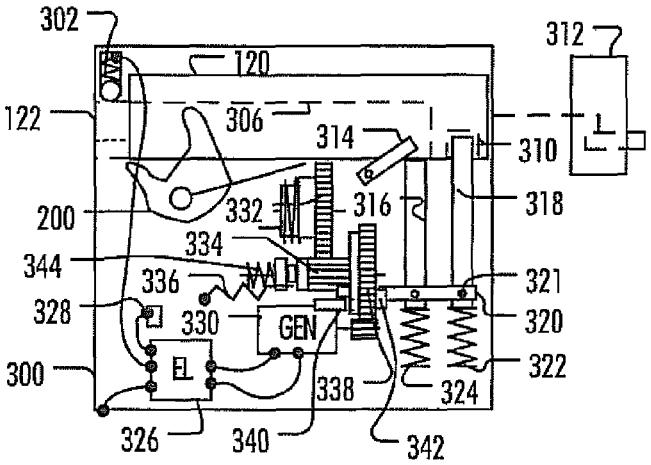
FIG. 3A illustrates an embodiment of a user-powered electromechanical lock and FIGS. 3B, 3C, 3D, 3E, 3F, 3G, 3H, 3I and 3J illustrate its operations.

With reference to FIG. 3A, the structure of an electromechanical lock 300 is explained. The lock 300 comprises an electronic circuit 326 configured to read data from an external source, and match the data against a predetermined criterion. The electronic circuit 326 may be implemented as one or more integrated circuits, such as application-specific integrated circuits ASIC. Other embodiments are also feasible, such as a circuit built of separate logic components, or a processor with its software. A hybrid of these different embodiments is also feasible. When selecting the method of implementation, a person skilled in the art will consider the requirements set for the power consumption of the device, production costs, and production volumes, for example.

The external source may be an electronic circuit configured to store the data. The electronic circuit may be an iButton® (www.ibutton.com) of Maxim Integrated Products, for example; such an electronic circuit may be read with 1-Wire® protocol. The electronic circuit may be placed in a key, for example, but it may be positioned also in another suitable device or object. The only requirement is that the electronic circuit 326 of the lock 300 may read the data from the external electronic circuit. The data transfer from the external electronic circuit to the electronic circuit 326 of the lock 300 may be performed with any suitable wired or wireless communication technique. In user-powered locks, produced energy amount may limit the techniques used. Magnetic stripe technology or smart card technology may also be used as the external source. Wireless technologies may include RFID technology, or mobile phone technology, for example. The external source may be a transponder, an RF tag, or any other suitable electronic circuit type capable of storing the data.

The data read from the external source is used for authentication by matching the data against the predetermined criterion. The authentication may be performed with SHA-1 (Secure Hash Algorithm) function, designed by the National Security Agency (NSA). In SHA-1, a condensed digital representation (known as a message digest) is computed from a given input data sequence (known as the message). The message digest is to a high degree of probability unique for the message. SHA-1 is called "secure" because, for a given algorithm, it is computationally infeasible to find a message that corresponds to a given message digest, or to find two different messages that produce the same message digest. Any change to a message will, with a very high probability, result in a different message digest. If security needs to be increased, other hash functions (SHA-224, SHA-256, SHA-384 and SHA-512) in the SHA family, each with longer digests, collectively known as SHA-2 may be used. Naturally, any suitable authentication technique may be used to authenticate the data read from the external source. The selection of the authentication technique depends on the desired security level of the lock 300 and possibly also on the permitted consumption of electricity for the authentication (especially in user-powered electromechanical locks).

The lock 300 also comprises a support 342 configured to move by electric power to a fulcrum position provided that the data matches the predetermined criterion, i.e. provided that the data is authenticated. The support 342 may be configured to be reset from the fulcrum position with mechanical power when the key is removed from the lock 300. The mechanical power may be provided by a spring 344, for example. The lock 300 may be configured so that the key is removable from the lock 300 only in a position where the key is insertable in the lock. An example of this is explained below in connection with FIGS. 1B and 1C.

The lock 300 also comprises a locking pin 318 configured to hold the lock 300, when engaged, in a locked state, and, when disengaged, in a mechanically openable state. The locking pin 318 may be configured to be engaged with mechanical power when the key is removed from the lock. The mechanical power may be provided by a spring 322, for example. This is explained below in connection with FIG. 3J.

The lock 300 also comprises a lever 320 coupled with the locking pin 318 configured to receive mechanical power, and to output the mechanical power to mechanically disengage the locking pin 318 provided that the support 342 is in the fulcrum position.

The lock 300 may comprise a driving pin 316 coupled with the lever 320 configured to input the mechanical power to the lever 320. The lever 320 may be configured to receive the mechanical power from insertion of a key. As illustrated in FIG. 3A, the lever 320 may be a third-class lever: the fulcrum is at the left-hand end of the lever 320, the mechanical power is inputted into the middle of the lever 320, and the mechanical power is outputted from the right-hand end of the lever 320.

A coupling 321 between the lever 320 and the locking pin 318 may act as another fulcrum, and the locking pin 318 remains stationary in a locked position provided that the data does not match the predetermined criterion, i.e. provided that the support 342 is not moved to the fulcrum position.

The lock 300 may comprise a lock cylinder 120. The locking pin 318 may be configured to implement the locked state so that, when engaged, the locking pin 318 holds the lock cylinder 120 stationary, and implement the mechanically openable state so that, when disengaged, the locking pin 318 releases the lock cylinder 120 rotatable by mechanical power. In the third-class lever the input effort is higher than the output load, but the input effort moves through a shorter distance than the load, i.e. with such lever 320 the locking pin 318 may securely hold the lock cylinder 120 in place in the locked state as the locking pin 318 penetrates deep enough into the wall of the lock cylinder 120. A cavity 310 may be formed in the lock cylinder 120 for the locking pin 318.

These embodiments, as well as the cooperation of the support 342, lever 320 and locking pin 318, will be explained in greater detail later.

The electromechanical lock 300 of FIG. 3A is user-powered, i.e. the user generates all the mechanical and electrical power needed for operating the lock 300. The lock 300 may comprise an electric generator 330 configured to generate electric power from mechanical power. The electric generator 330 may be a permanent magnet generator, for example. The output power of the electric generator 330 may depend on rotating speed, terminal resistance and terminal voltage of the electronic and the constants of the electric generator 330. The generator constants are set when the electric generator 330 is selected. The electric generator 330 may be implemented by a Faulhaber motor 0816N008S, which is used as a generator, for example. The term electric generator refers to any generator/motor capable of generating electric power from mechanical power.

FIG. 3A illustrates a solution where only one electric generator 330 is used to generate the electric power and feed the electric power to the electronic circuit 326, and thereupon move the support 342 (to the fulcrum position) with the (generated) electric power. In such a solution, the electric generator 330 is also used as an actuator of the lock; the actuator may put the lock 300 in a mechanically openable state under the control of the electronic circuit 326. The support 342 may be coupled with a shaft of the electric generator 330. The shaft may be a moving shaft; a rotating shaft, for example.

FIG. 3A illustrates many other possible components of the lock 300. The lock 300 may further comprise keyways 122, 306, an electric contact 302, a key follower 200, an arm 314, a spring 324, a threshold device 332, a clutch 334, a main wheel 338, a stopper 340, a position switch 328, and a clutch opener 336. Furthermore, the lock may be coupled to bolt mechanism 312. The electric generator 330 may rotate through the main wheel 338 when the threshold device 332 is moving, provided that the clutch 334 is closed.

Figure 1A:
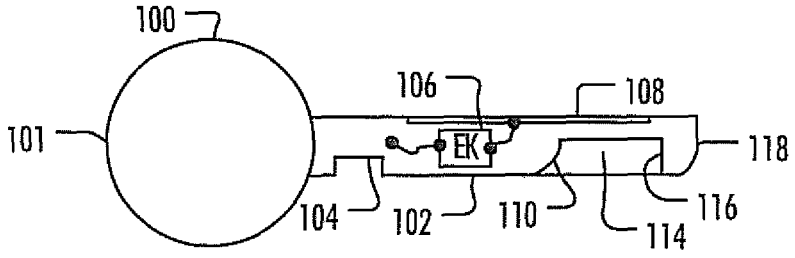
FIGS. 1B and 1C illustrate various positions of the key.
Figure 1B:
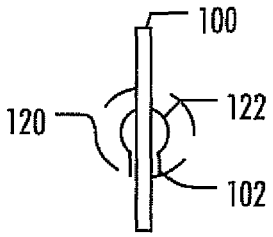
Figure 1C:
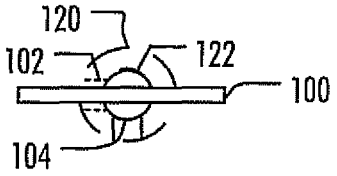

With reference to FIGS. 1A, 1B and 1C, a key 100 and its positions in the lock 300 are explained.

In FIG. 1A, the key 100 comprises a key grip 101 and a key body 102 (in the form of a bar, for example). The key 100 may also comprise key electronics 106 connected to a sliding contact 108 and the key body 102. The key electronics 106 may comprise an electronic circuit for storing the data (read by the electronic circuit 326 of the lock 300). The key body 102 may comprise different shapes: a rotating position shape 104, a first shape 118, a gap 114, a second shape 110, and a third shape 116. The key body 102 may also have axial guides for better positioning control.

In FIG. 1B, the key 100 is shown in a zero position. In the zero position the key 100 may be inserted in or withdrawn from the lock 300 through the keyway shape 122.

In FIG. 1C, the key 100 is rotated off the zero position. While in the off-zero position, the key body 102 and the keyway shape 122 of the lock prevent removal of the key 100.

Figure 2A:
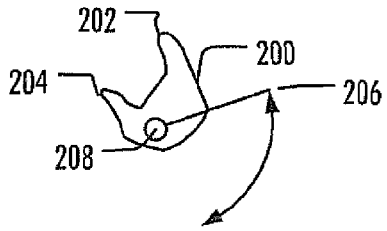
FIGS. 2A, 2B and 2C illustrate an embodiment of a key follower and its positions.
Figure 2B:
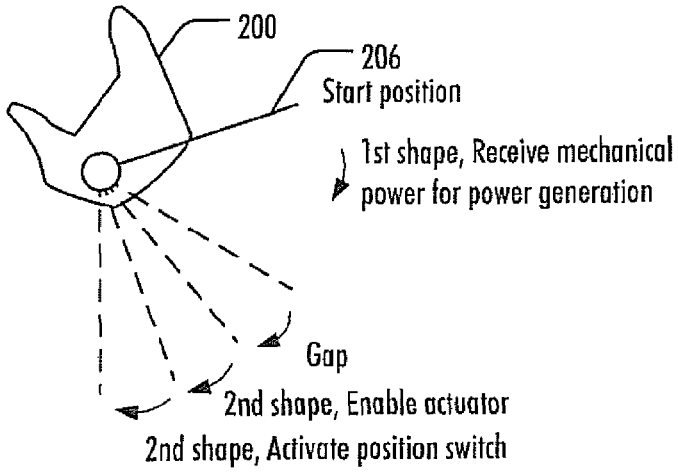
Figure 2C:
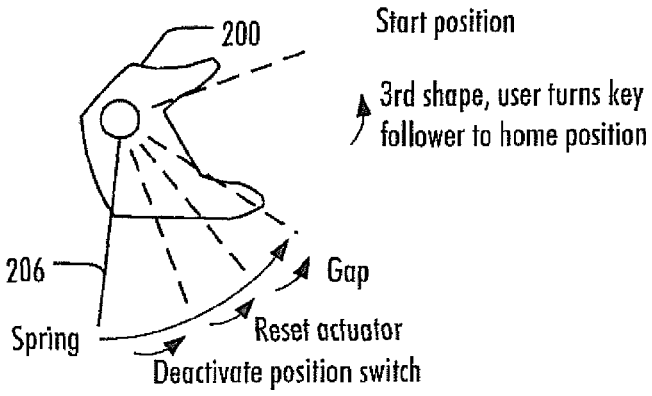

Next, with reference to FIGS. 2A, 2B and 2C a key follower 200 and its positions within the electromechanical lock are explained. The key follower 200 is described in greater detail in another simultaneously filed application: EP 07112676.7.

As illustrated in FIG. 2A, the key follower 200 comprises a first claw 202, a second claw 204 and a swing lever 206. The key follower 200 rotates around a shaft 208.

Figure 3B:
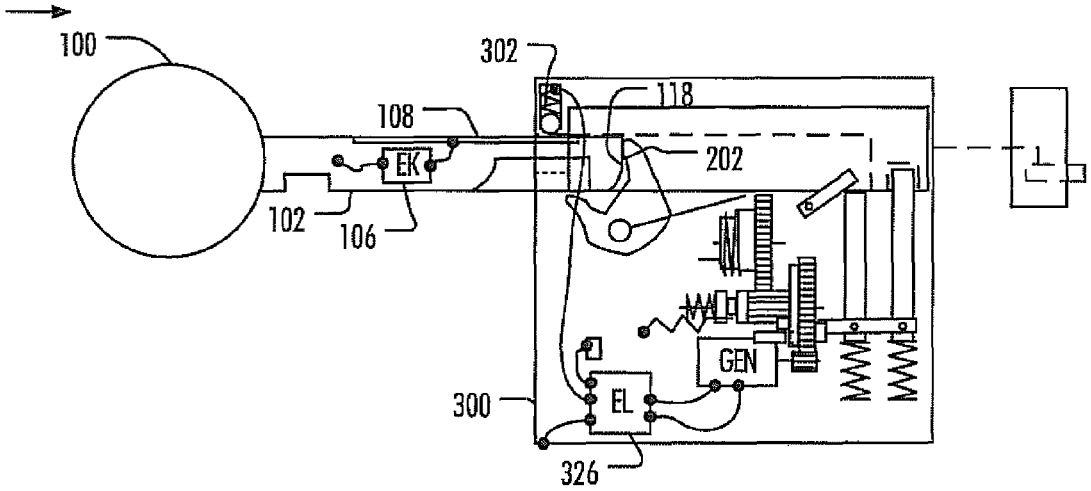
Figure 3C:
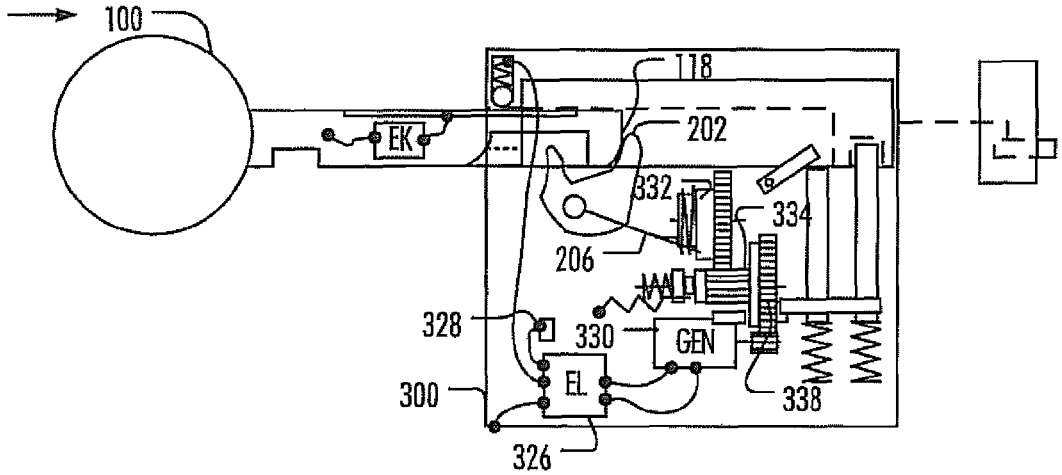
Figure 3D:
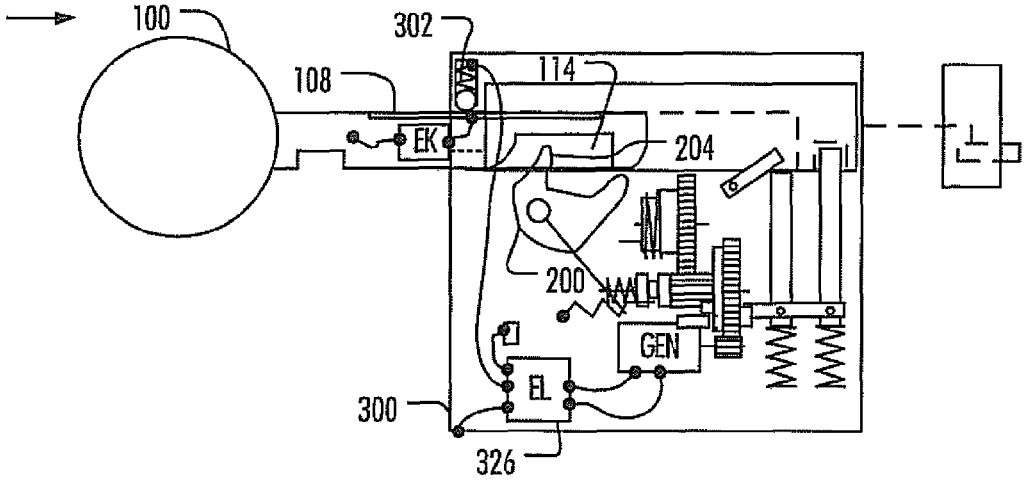
Figure 3E:
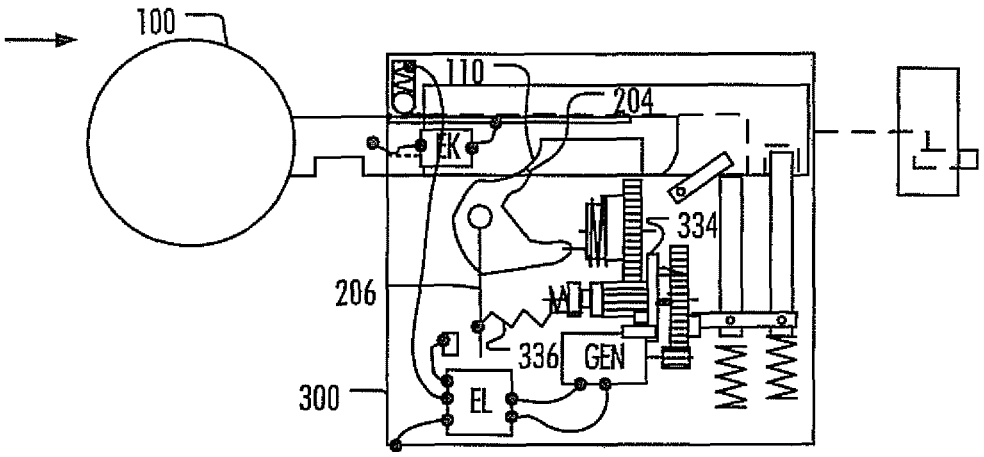
Figure 3F:
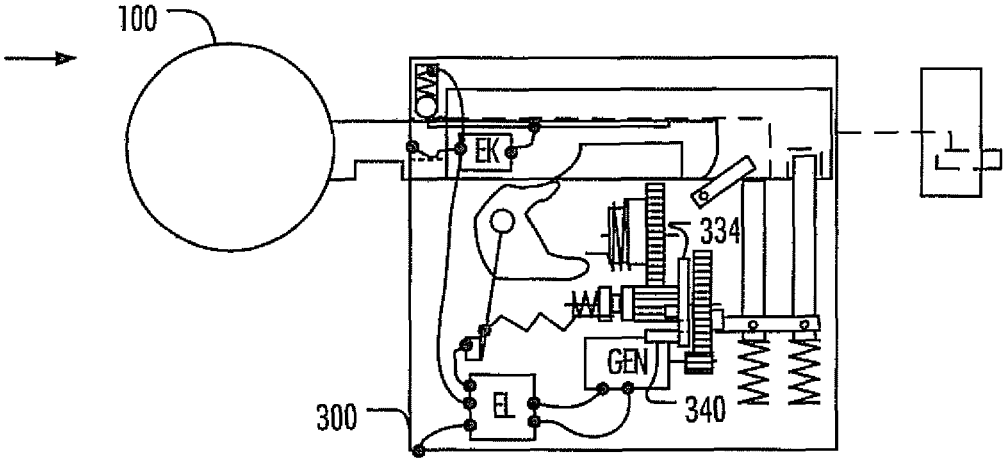
Figure 3G:
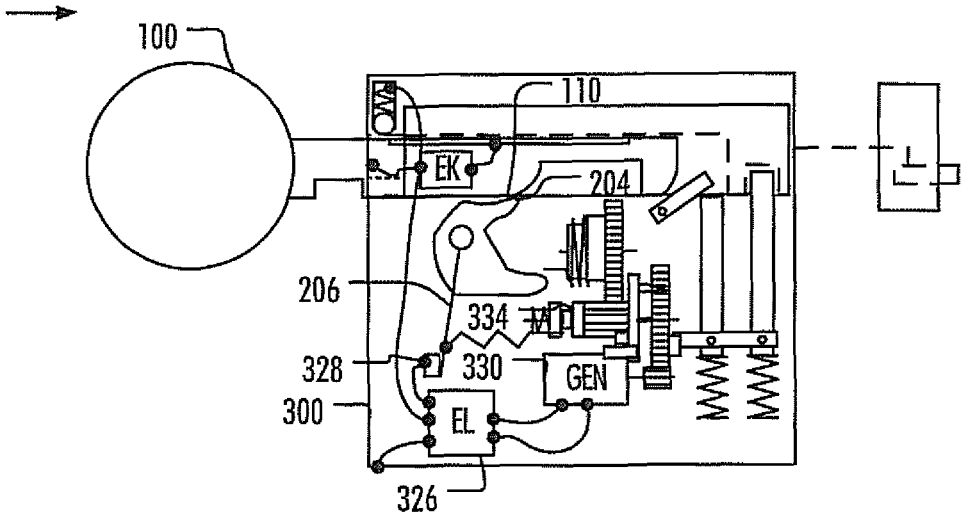
Figure 3H:
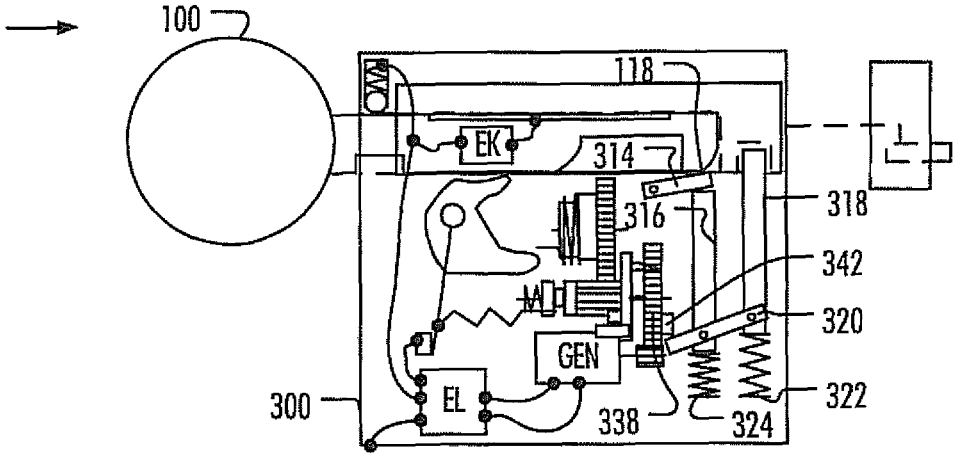
Figure 3I:
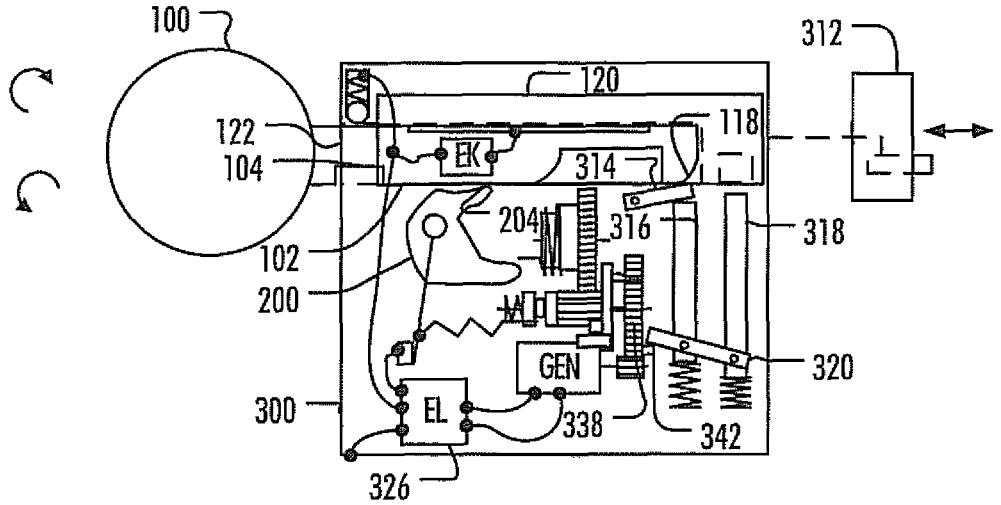

FIG. 2B illustrates the positions and functions of the key follower 200 when the key 100 is inserted into the lock 300:

FIGS. 3B and 3C will further illustrate reception of mechanical power with the first shape 118 of the key 100;

FIG. 3D will further illustrate the operation allowed by the gap 114 of the key;

FIGS. 3E and 3F will further illustrate the operation of the actuator with the second shape 110 of the key 100; and FIGS. 3G, 3H and 3I will further illustrate the operation after the position switch 328 is activated by the second shape 110 of the key.

Figure 3J:
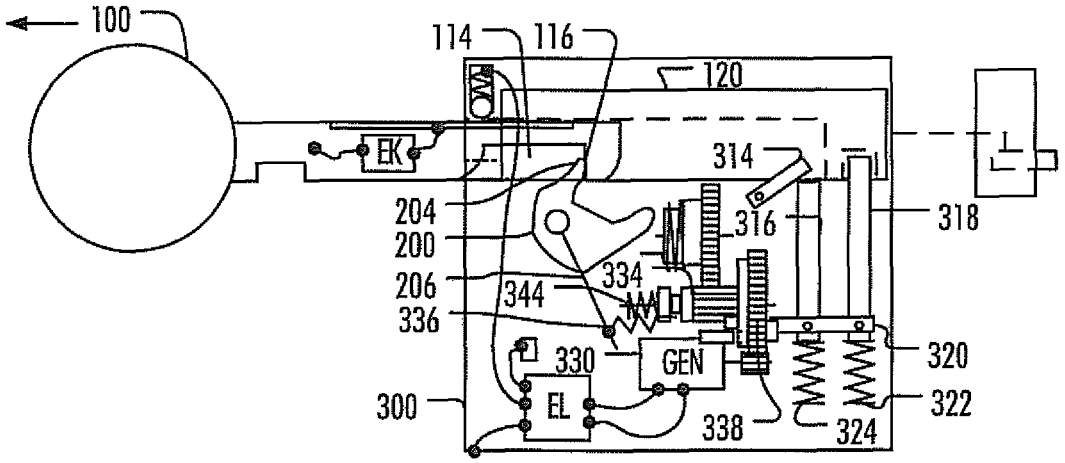

FIG. 2C illustrates the positions and functions of the key follower 200 when the key 100 is withdrawn from the lock 300: the key follower 200 may be returned to the gap position by a spring, whereby the position switch 328 is deactivated and the actuator is reset, and after that the third shape 116 of the key 100 may return the key follower 200 to its home position. FIG. 3J will further illustrate these operations.

FIG. 3B illustrates the lock status when the first shape 118 of the key 100 is inserted against the first claw 202 in the lock 300. The key electronics 106 may be connected to the electronic circuit 326 so that one electrical connection is made between the electric contact 302 and the slide contact 108, and the other electrical connection between the key body 102 and the lock frame 300.

In FIG. 3C, the key 100 is inserted to a threshold position in the lock 300: the first shape 118 of the key 100 is still in contact with the first claw 202. The threshold device 332 is armed by the swing lever 206. When the key 100 is inserted deeper into the lock, the threshold device 332 is launched and it returns to the home position by a spring. Electric power is produced by the electric generator 330 to the electronic circuit 326 when the threshold device 332 is moving. The threshold device 332 is illustrated in more detail in another patent application by the applicant: EP 05 112 272.9.

In FIG. 3D, the key 100 continues to move into the lock 300. The key follower 200 is not moving because the second claw 204 is in the gap 114 of the key 100: delay is made for the electric power generation and the communication. After a sufficient voltage level is reached, the electronic circuit 326 starts, communicates with the key electronics 106 through the electric contacts 302, 108, and authenticates the key 100.

In FIG. 3E, the second claw 204 is pushed forward by the second shape 110 of the key. The actuator operation is enabled by opening the clutch 334 with the swing lever 206 and the clutch opener 336. The clutch 334 is described in greater detail in another simultaneously filed application: EP 07112677.5.

In FIG. 3F, the actuator enabling operation is started before the power generation phase is ended, i.e. the key 100 may be inserted too fast into the lock 300. In such a case, the actuator operation is disabled, because the clutch 334 may only be opened when it is returned to the home position against to the stopper 340. The lock 300 cannot be opened.

Figure 5A:
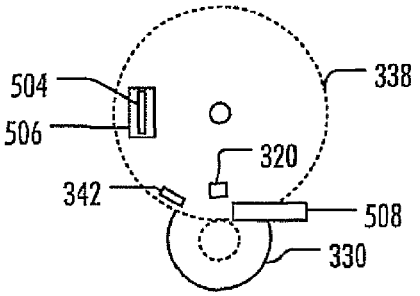
FIGS. 5A, 5B, 5C, 5D, 5E and 5F illustrate an embodiment of an electronic control and mechanical reset of the locking mechanism.
Figure 5B:
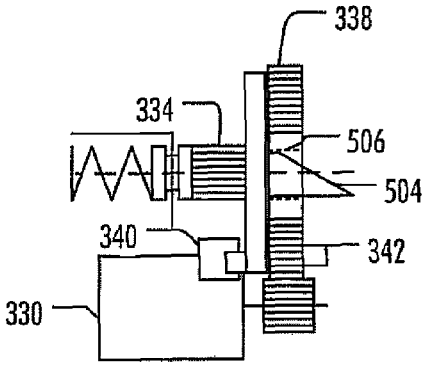

In FIGS. 5A and 5B, the clutch 334 is closed and rotation of the main wheel 338 is blocked by the shapes 504, 506. The main wheel 338 is not rotatable by the electric generator 330, and the support 342 is not set under the lever 320. The locking pin 318 is kept in closed position, even though the driving pin 316 is pushed down by the user of the key 100.

In FIG. 3G, the clutch 334 is opened and the position switch 328 is activated by the second claw 204 and the end of the second shape 110 of the key. The electronic circuit 326 controls the generator 330 as an electric motor when the position switch 328 is activated as follows: the generator 330 is driven in the open direction as illustrated in FIGS. 5E and 5F, if the key 100 is authenticated, and kept in the closed position as illustrated in FIGS. 5C and 5D, if the key 100 is not authenticated.

In FIG. 3H, the main wheel 338 is kept in the closed position. The support 342 is not under the lever 320. The arm 314, the driving pin 316 and the lever 320 are pushed down by the first shape 118 of the key, but the locking pin 318 is kept in the closed position by the spring 322 and the lock 300 cannot be opened. As shown, the lever 320 misses the support 342 (and hence the fulcrum), if the key 100 is not authenticated. The mechanics of the lock 300 remain secure against malicious manipulation.

In FIG. 3I, the main wheel 338 is driven to the open position by the electronic circuit 326. The support 342 is set under the lever 320. The arm 314 and the driving pin 316 are pushed down by the first shape 118 of the key 100, and the locking pin 318 is pushed down through the lever 320 by the driving pin 316. As a result, the lock 300 is in the mechanically openable state, and the bolt mechanism 312 may be moved by rotating the key 100. When the key 100 is rotated, the lock cylinder 120 provides support for the second claw 204 of the key follower 200 so that it keeps its position during rotation. The key 100 has to be returned to the zero position, as illustrated in FIG. 1B, before it may be withdrawn from the lock 300.

Figure 5C:
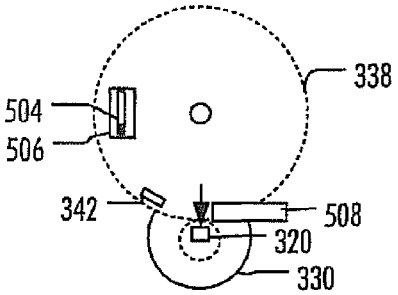
Figure 5D:
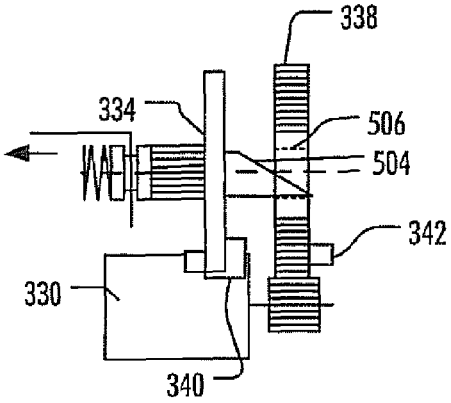
Figure 5E:
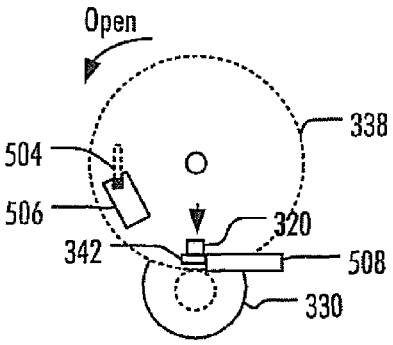
Figure 5F:
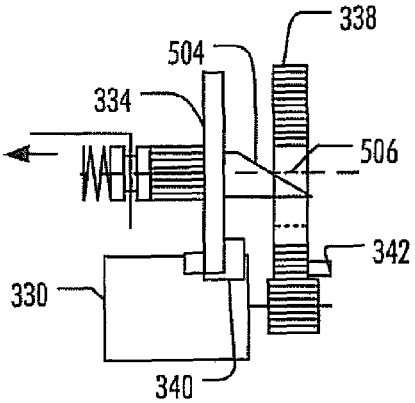

The opening is also illustrated in FIGS. 5C and 5D. The clutch 334 is opened and rotation of the main wheel 338 is enabled by the shapes 504, 506. As further illustrated in FIGS. 5E and 5F, the main wheel 338 is rotated by the electric generator 330 to the stopper 508, the support 342 is set under the lever 320, and the locking pin 318 may be opened by the user of the key 100 through the arm 314, the driving pin 316 and the lever 320.

In FIG. 3J, withdrawal of the key 100 is in progress. The locking pin 318 is returned to the closed position by the spring 322. The driving pin 316 and the arm 314 are returned to their initial positions by the spring 324. The lever 320 is returned to initial position together with the driving pin 316 and the locking pin 318. The clutch 334 is closed by the spring 344 and the main wheel 338 is reset. The second claw 204 is returned into the gap 114 by the clutch opener 336. The third shape 116 of the key 100 and the second claw 204 return the key follower 200 to the starting position as illustrated in FIGS. 3B and 2C, when the key 100 is withdrawn from the lock 300.

Figure 4A:
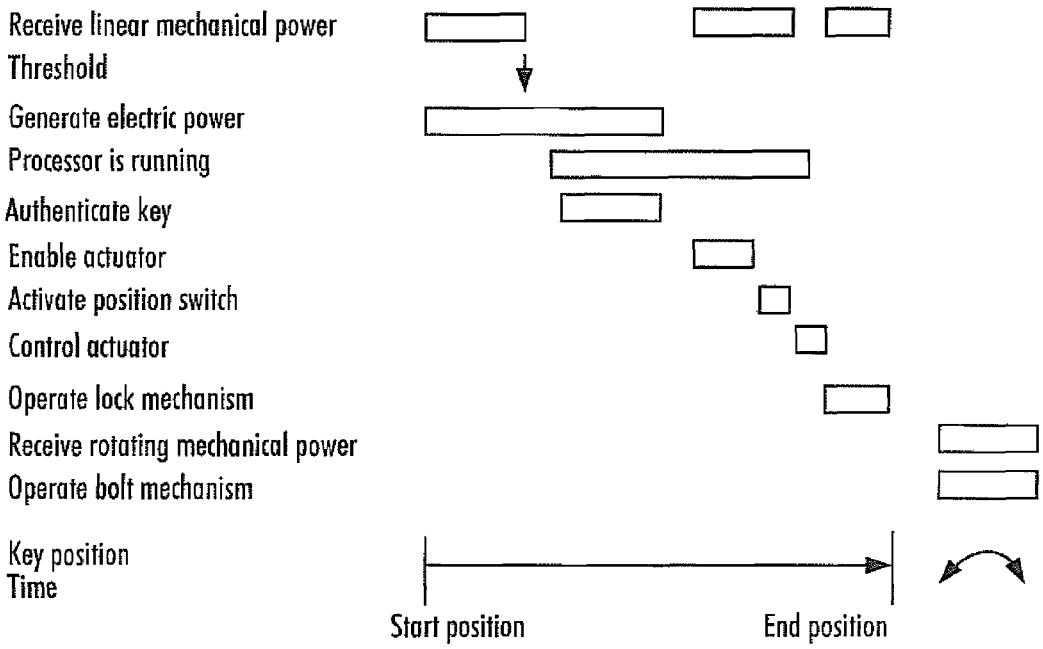
FIGS. 4A and 4B illustrate timing and order of the operations in the electromechanical lock.

FIG. 4A illustrates the order of the lock functions when the key 100 is inserted into the lock 300 in a specified speed. From the key 100 insertion, linear mechanical power is received. Electric power is generated with a part of the received linear mechanical power. A processor of the lock electronics 326 starts when sufficient voltage is generated and it stops when voltage drops below a sufficient level. The key 100 is authenticated with the generated electric power. The actuator is enabled with the mechanical power. The position switch 328 is activated after the key 100 has been inserted in a required depth. Thereupon, the actuator is controlled with the generated electric power, and the lock mechanism is further operated with the mechanical power. If the insertion speed of the key 100 is so slow that the voltage drops below the sufficient level before the position switch 328 is activated, the actuator 330 is not driven, and the lock 300 remains in the locked state. If the key 100 is inserted too fast, the position switch 328 is activated before the key authentication process is ready, and the lock 300 is kept in the closed state. Finally, rotating mechanical power is received and used to operate the bolt mechanism 312.

Figure 4B:
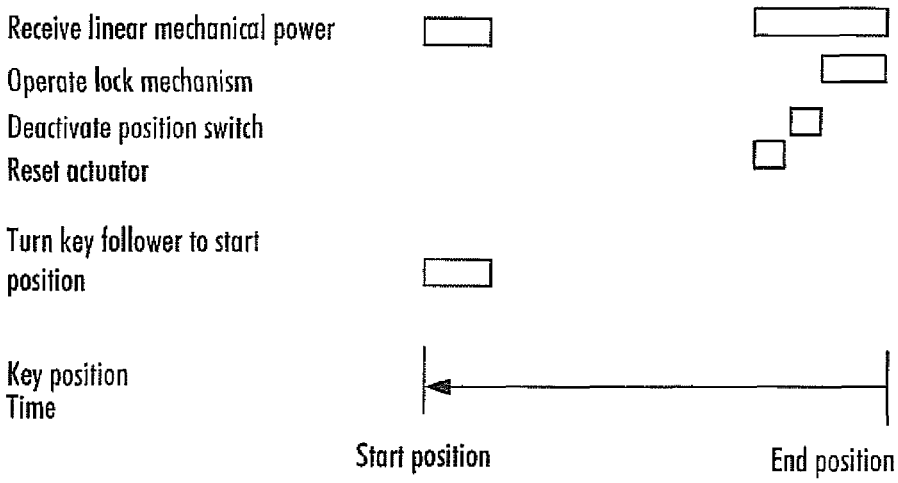

FIG. 4B illustrates the lock functions when the key 100 is withdrawn from the lock 300. Linear mechanical power is received from the key 100 removal. With the received mechanical power, the lock mechanism is operated, and, after the position switch 328 is deactivated, the actuator is reset. Thereupon, the key follower 200 is turned to the start position with the mechanical power.

The electromechanical lock may be user-powered, as illustrated in FIGS. 3A to 3J, but it may also be battery-powered. In both cases, the minimization of electric power consumption is desirable, in the former case for minimizing the amount of electric power that needs to be generated, and in the latter case for maximizing the duration of the battery.

Figure 6A:
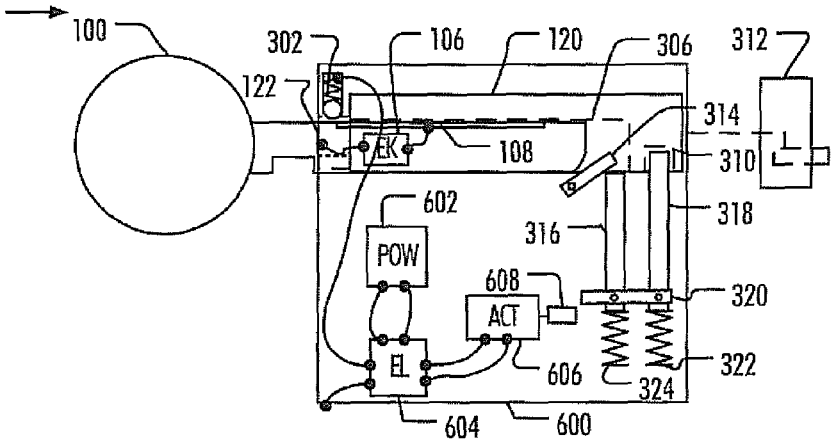
FIGS. 6A, 6B and 6C illustrate an embodiment of a battery-powered electromechanical lock where a linearly moving actuator is used.

FIG. 6A illustrates the main components of a battery-powered electromechanical lock. The lock 600 may comprise the lock cylinder 120, the keyways 122, 306, the electric contact 302, the arm 314, the driving pin 316, the locking pin 318, the lever 320, the springs 322, 324, a power source 602, an electronic circuit 604, an actuator 606, and a support 608. Furthermore, the lock may be coupled to the bolt mechanism 312. Internal or external battery may be used as the power source 602. An electromagnetic solenoid or a piezoelectric device may be used as the actuator 606 moving the support 608.

In FIG. 6A, the key 100 is inserted into the lock 600. The electronic circuit 604 reads data from the key electronics 106 through the electric contacts 302 and 108. The electronic circuit 604 detects position of the key 100 when the sliding contact 108 ends, and controls the actuator 606 depending on result of the key 100 validation.

Figure 6B:
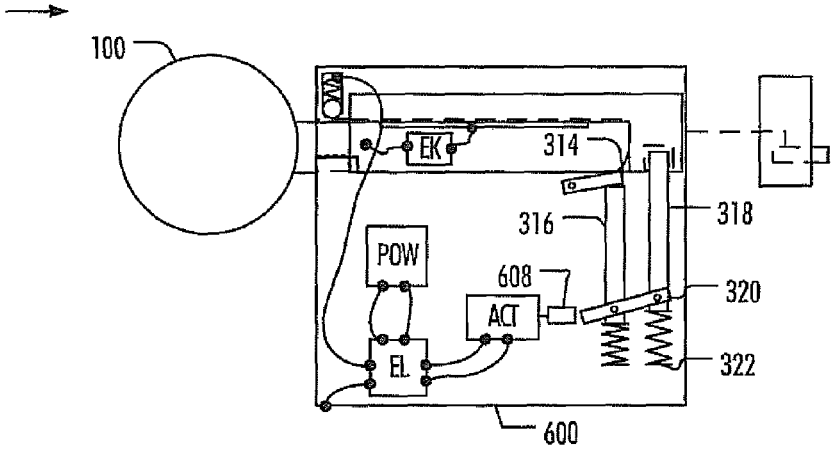

In FIG. 6B, the support 608 is not set under the lever 320 before the key 100 is inserted into the bottom of the lock 600. Even if the arm 314 and the driving pin 316 push the lever 320 down by the first shape 118 of the key 100, the locking pin 318 is kept in the closed position by the spring 322, because the support 608 is not under the lever 320 and hence the lever 320 misses its fulcrum. The lock 600 cannot be opened.

Figure 6C:
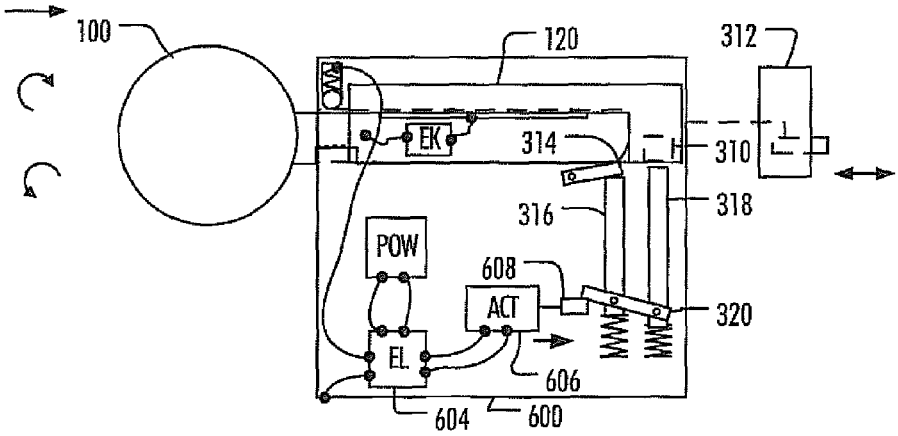

In FIG. 6C, the support 608 is set to the open position by the electronic circuit 604, i.e. the actuator 606 sets the support 608 under the lever 320. The mechanical power created by the insertion of the key 100 is received by the arm 314. The arm 314 pushes down the driving pin 316, whereby the mechanical power is levered by the lever 320 to the locking pin 318.

The lever 320 ejects the locking pin 318 from the cavity 310 in the lock cylinder 120. In order to open the lock 600, the bolt 312 may now be moved by rotating the key 100.

Figure 7A:
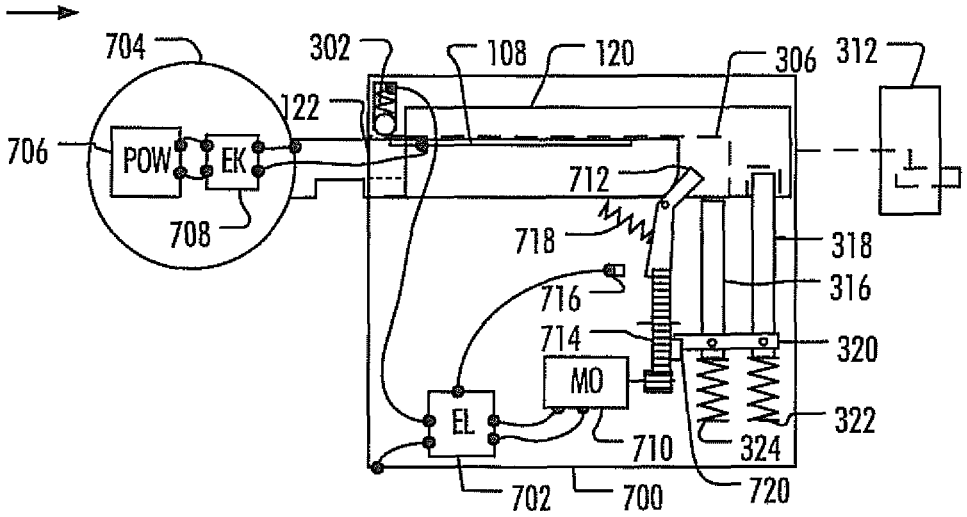
FIGS. 7A, 7B, 7C and 7D illustrate an embodiment of a battery-powered electromechanical lock where a rotating actuator is used.

FIG. 7A illustrates an electromechanical lock 700 powered by a battery 706 through key electronics 708 in a key 704. The lock 700 may comprise the lock cylinder 120, the keyways 122, 306, the electric contact 302, the driving pin 316, the locking pin 318, the lever 320, springs 322, 324, 718, an electronic circuit 702, an electric motor 710 coupled to a gearwheel 714, a support 720, an arm 712, and an arm position sensor 716. Furthermore, the lock may be coupled to the bolt mechanism 312.

Figure 8A:
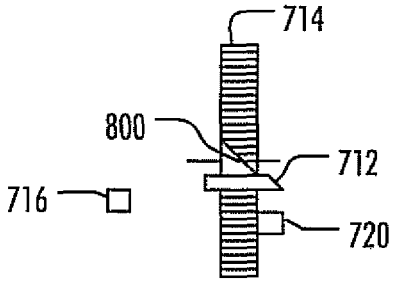
FIGS. 8A, 8B, 8C and 8D illustrate an embodiment of an electronic control and mechanical reset of a battery-powered electromechanical lock.

In FIG. 7A, the key 704 is inserted into the lock 700. The electronic circuit 702 reads data from the key electronics 708 through the electric contacts 302 and 108. The electronic circuit 702 waits for the arm position sensor 716 to be activated by the arm 712. FIGS. 7A and 8A illustrate an embodiment of reset mechanism of the gearwheel 714, the gearwheel 714 is kept in a locked state by the arm 712 and its spring 718.

Figure 7B:
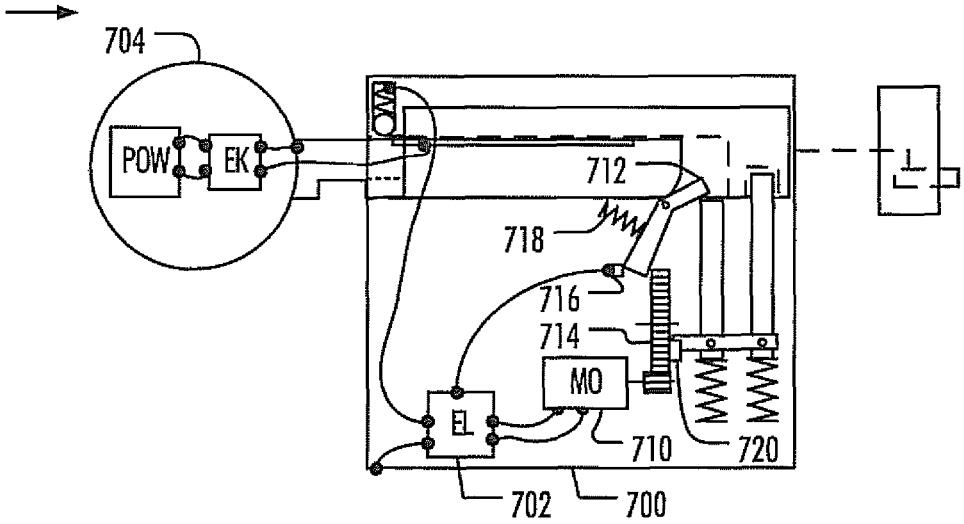
Figure 8B:
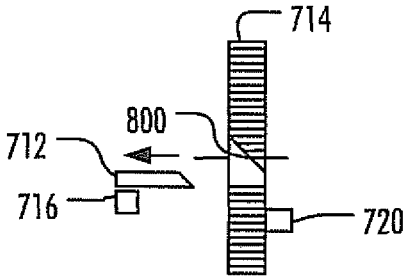

In FIGS. 7B and 8B, the key 704 is inserted into the lock 700 so that the arm 712 is turned, the gearwheel 714 is released, the arm position sensor 716 is activated and the electric motor 710 may be controlled on the basis of the key authentication by the electronic circuit 702.

Figure 7C:
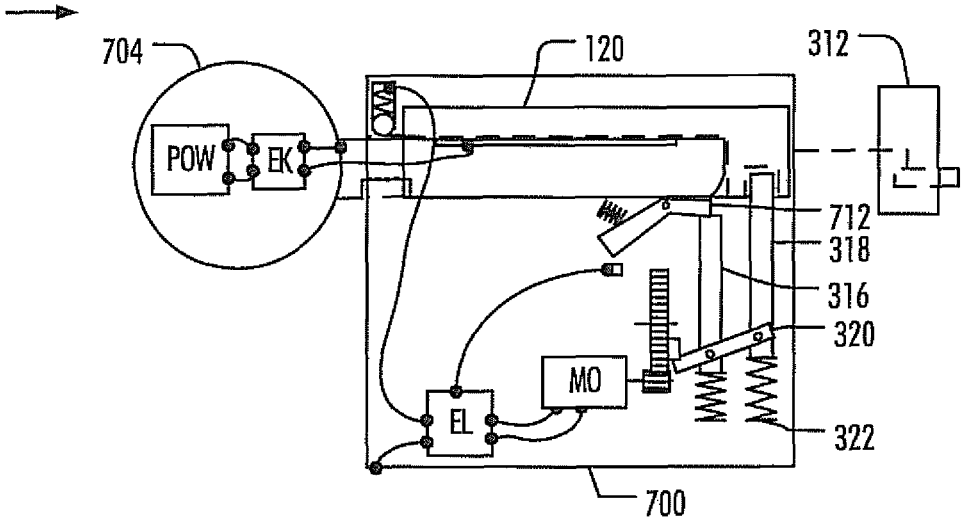

In FIG. 7C, the support 720 is not set under the lever 320 before the key 704 is inserted into the bottom of the lock 700. So, even if the arm 712 and the driving pin 316 and the lever 320 are pushed down by the key 704, the locking pin 318 is kept in the closed position by the spring 322. The mechanical power is not levered to the locking pin 318, because the lever 320 misses its fulcrum. The lock 700 cannot be opened, i.e. the locking pin 318 prevents the rotation of the lock cylinder 120, and hence the operation of the bolt 312.

Figure 7D:
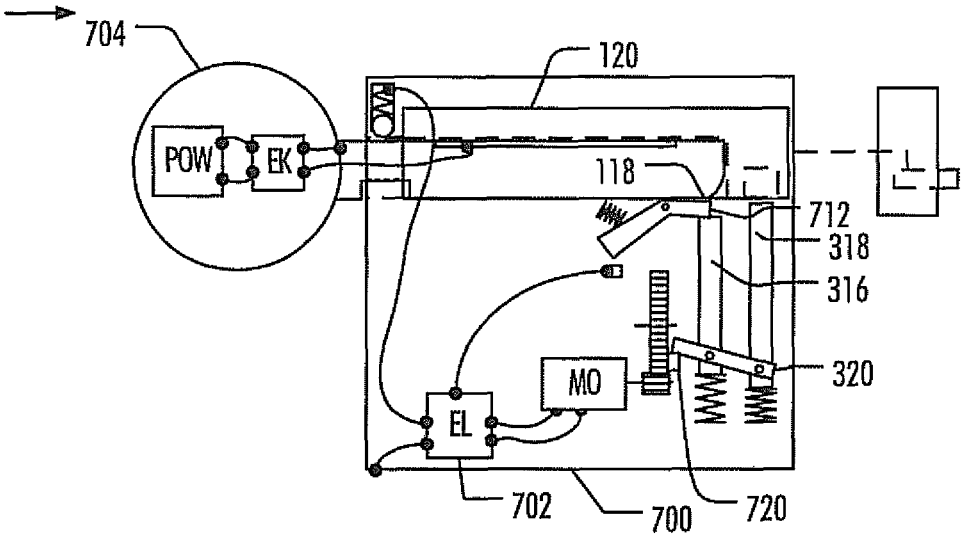
Figure 8C:
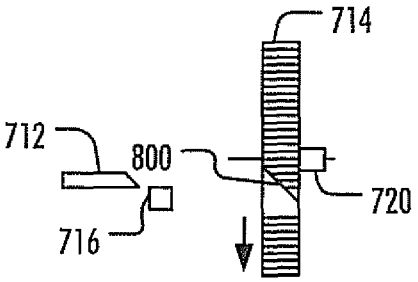

In FIGS. 7D and 8C, the support 720 is set to the open position by the electronic circuit 702. The support 720 is set under the lever 320, the arm 712 and the driving pin 316 are pushed down by the first shape 118 of the key and the locking pin 318 is pushed down through the lever 320 by the driving pin 316. The lock 700 is in the mechanically openable state, and the bolt 312 may be moved by rotating the key 704.

Figure 8D:
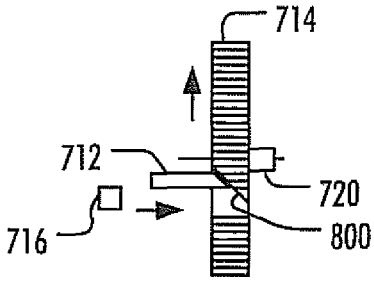

In FIG. 8D, withdrawal of the key 704 is in progress. The spring 718 (illustrated in FIG. 7A) returns the arm 712 into a shape 800 of the gearwheel 714 and turns it to the locked position as illustrated in FIG. 8A.

Figure 9:
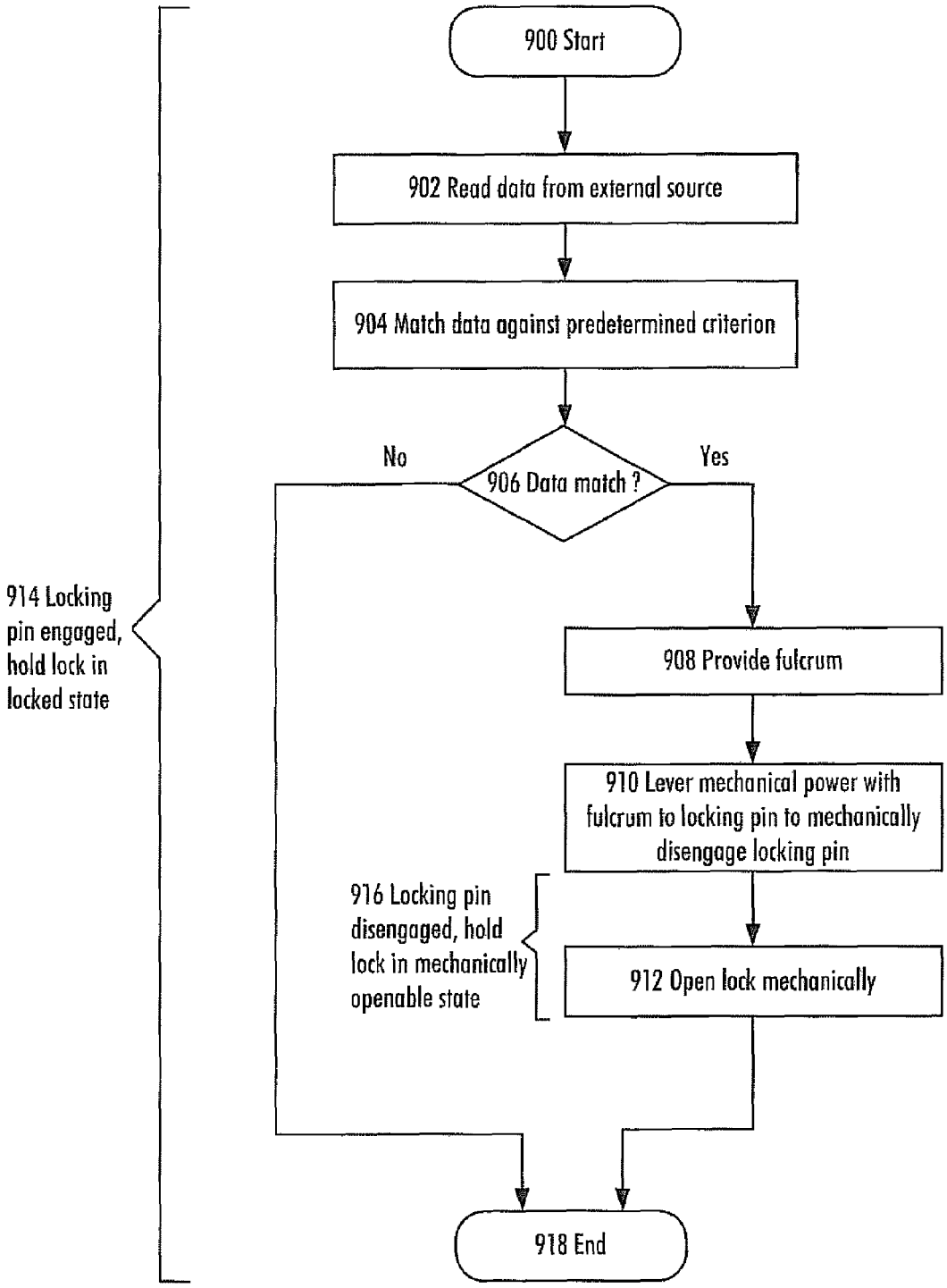
FIG. 9 illustrates a method for operating an electromechanical lock.

Next, a method for operating an electromechanical lock will be described with reference to FIG. 9. Other functions, not described in this application, may also be executed between the operations or within the operations. The method starts in 900.

Normally, in 914, a locking pin is engaged, and the locking pin holds the lock in a locked state.

In 902, data is read from an external source.

In 904, the data is matched against a predetermined criterion.

In 906, the match of the data against the predetermined criterion is checked.

If the data matches the predetermined criterion, a fulcrum is provided in 908. If the fulcrum is provided, mechanical power is levered with the fulcrum to the locking pin to mechanically disengage the locking pin in 910. In 916, the locking pin is disengaged, and the locking pin holds the lock in a mechanically openable state. After that, the lock is mechanically opened in 912.

If the data does not match the predetermined criterion, the lock remains closed, i.e. the locking pin remains engaged, and the locking pin continues to hold the lock in the locked state in 914.

The method ends in 918.

The method may be enhanced with the embodiments of the electromechanical lock described earlier.

It will be obvious to a person skilled in the art that, as technology advances, the inventive concept can be implemented in various ways. The invention and its embodiments are not limited to the examples described above but may vary within the scope of the claims.

The invention claimed is:

1. An electromechanical lock, comprising:

an electronic circuit configured to read data from an external source, and match the data against a predetermined criterion;

a support configured to move by electric power to a fulcrum position provided that the data matches the predetermined criterion;

a locking pin configured to hold the lock, when engaged, in a locked state, and, when disengaged, in a mechanically openable state;

a lever coupled with the locking pin and having two distal ends, the lever being configured to receive mechanical power provided that the data matches the predetermined criterion such that the lever is supported by the support at the fulcrum position and one of the distal ends of the lever that is farther to the support is pushed down by the mechanical power, thereby mechanically disengaging the locking pin provided that the support is in the fulcrum position; and an electric generator configured to generate the electric power from the mechanical power, wherein the electric generator is further configured to generate the electric power and feed the electric power to the electronic circuit such that the support is moved to the fulcrum position by the electric power.

2. The electromechanical lock of claim 1, wherein the support is coupled with a shaft of the electric generator.

3. The electromechanical lock of claim 2, wherein the shaft comprises a moving shaft.

4. The electromechanical lock of claim 1, wherein a coupling between the lever and the locking pin acts as a fulcrum, and the locking pin remains stationary in a locked position provided that the data does not match the predetermined criterion.

5. The electromechanical lock of claim 1, further comprising a driving pin coupled with the lever configured to input the mechanical power to the lever, wherein the locking pin is closer to the one of the distal ends of the lever, and the driving pin is closer to the other one of the distal ends of the lever.

6. The electromechanical lock of claim 1, wherein the lever is further configured to receive the mechanical power from insertion of a key.

7. The electromechanical lock of claim 1, wherein the lever comprises a third-class lever.

8. The electromechanical lock of claim 1, wherein the lock further comprises a lock cylinder, and the locking pin is further configured to implement the locked state so that, when engaged, the locking pin holds the lock cylinder stationary, and to implement the mechanically openable state so that, when disengaged, the locking pin releases the lock cylinder rotatable by mechanical power.

9. The electromechanical lock of claim 8, wherein the lock is further configured so that a key is removable from the lock only in a position where the key is insertable in the lock.

10. The electromechanical lock of claim 1, wherein the locking pin is further configured to be engaged with mechanical power when a key is removed from the lock.

11. The electromechanical lock of claim 1, wherein the support is further configured to be reset from the fulcrum position with mechanical power when a key is removed from the lock.

12. The electromechanical lock of claim 2, wherein a coupling between the lever and the locking pin acts as a fulcrum, and the locking pin remains stationary in a locked position provided that the data does not match the predetermined criterion.

13. The electromechanical lock of claim 3, wherein a coupling between the lever and the locking pin acts as a fulcrum, and the locking pin remains stationary in a locked position provided that the data does not match the predetermined criterion.

14. The electromechanical lock of claim 1, wherein a coupling between the lever and the locking pin acts as a fulcrum, and the locking pin remains stationary in a locked position provided that the data does not match the predetermined criterion.

15. The electromechanical lock of claim 1, wherein the support serves as a fulcrum of the lever at the fulcrum position when the lever levers the mechanical power to mechanically disengage the locking pin.

16. The electromechanical lock of claim 1, wherein when the lever is supported by the support at the fulcrum position, the one of the distal ends of the lever that is farther to the support is pushed down to be lower than the other one of the distal ends of the lever that is closer to the support.

17. The electromechanical lock of claim 1, wherein the support is spaced apart from the lever when the support is not at the fulcrum position.

18. A method for operating an electromechanical lock, the electromechanical lock having a lever coupled with a locking pin, and a support, the lever having two distal end, the method comprising:

reading data from an external source;

matching the data against a predetermined criterion;

moving the support by electric power to a fulcrum position provided that the data matches the predetermined criterion;

holding the lock by the locking pin, when engaged, in a locked state, and, when disengaged, in a mechanically openable state; and receiving mechanical power by the lever provided that the data matches the predetermined criterion such that the lever is supported by the support at the fulcrum position and one of the distal ends of the lever that is farther to the support is pushed down by the mechanical power, thereby mechanically disengaging the locking pin.

19. The method of claim 18, wherein when the lever is supported by the support at the fulcrum position, the one of the distal ends of the lever that is farther to the support is pushed down to be lower than the other one of the distal ends of the lever that is closer to the support.

20. The electromechanical lock of claim 18, wherein the support is spaced apart from the lever when the support is not at the fulcrum position.

21. An electromechanical lock, comprising:

means for reading data from an external source;

means for matching the data against a predetermined criterion;

means for providing a fulcrum provided that the data matches the predetermined criterion;

holding means for holding the lock, when engaged, in a locked state, and, when disengaged, in a mechanically openable state;

means for receiving mechanical power provided that the data matches the predetermined criterion such that the receiving means is supported by the providing means at the fulcrum and one of two distal ends of the receiving means that is farther to the providing means is pushed down by the mechanical power, thereby mechanically disengaging the holding means;

an electric generator configured to generate electric power from the mechanical power, wherein the electric generator is further configured to generate the electric power such that the providing means is moved to the fulcrum by the electric power.

22. The electromechanical lock of claim 21, wherein the providing means is a support configured to move by the electric power to a fulcrum position provided that the data matches the predetermined criterion, and the receiving means is a lever coupled with the locking pin.

23. The electromechanical lock of claim 22, wherein when the lever is supported by the support at the fulcrum position, the one of the distal ends of the lever that is farther to the support is pushed down to be lower than the other one of the distal ends of the lever that is closer to the support.

24. The electromechanical lock of claim 22, wherein the support is spaced apart from the lever when the support is not at the fulcrum position.

* * * * *